US008348789B1

(12) United States Patent
Walterscheid

(10) Patent No.: US 8,348,789 B1
(45) Date of Patent: Jan. 8, 2013

(54) THROWING TOY WITH TAIL AND IN-LINE TAB GRIP

(76) Inventor: Steve Walterscheid, Banks, OR (US)

( * ) Notice: Subject to any disclaimer, the term of this patent is extended or adjusted under 35 U.S.C. 154(b) by 272 days.

(21) Appl. No.: 12/758,932

(22) Filed: Apr. 13, 2010

Related U.S. Application Data

(63) Continuation-in-part of application No. 12/167,223, filed on Jul. 2, 2008, now Pat. No. 8,012,049.

(51) Int. Cl.
*A63B 65/02* (2006.01)

(52) U.S. Cl. ..... 473/578

(58) Field of Classification Search ..... 124/5; 473/578, 473/582, 585, 586
See application file for complete search history.

(56) References Cited

U.S. PATENT DOCUMENTS 2,477,531 A * 7/1949 Volman ..... 473/570
3,021,640 A * 2/1962 Moore ..... 446/231
3,965,882 A * 6/1976 Ehrens et al. ..... 124/18
4,844,304 A * 7/1989 Lenderink ..... 473/596
7,001,292 B1 * 2/2006 Rappaport ..... 473/570
7,871,344 B1 * 1/2011 Massman ..... 473/578

* cited by examiner

*Primary Examiner* — John Ricci
(74) *Attorney, Agent, or Firm* — LaMorte & Associates, P.C.

(57) ABSTRACT

A hand-thrown projectile having an enlarged head made from a soft material. A shaft has a semi-flexible section and a flexible section. The flexible section is interposed between the semi-flexible section and its rear end. The flexible section is created by flattening the plastic of the shaft into a wide, easily grasped tab. A plurality of stabilization fins are provided that radially extend from the semi-flexible section of the shaft. To toss the projectile, a person grasps the flexible tab. As the projectile is thrown, inertia and the acceleration forces created by the throw cause the semi-flexible section of the shaft to bend and store spring energy. Upon release of the flexible tab, the energy stored in the bent shaft is released and is transferred into the initial velocity of the projectile.

18 Claims, 4 Drawing Sheets

THROWING TOY WITH TAIL AND IN-LINE TAB GRIP

RELATED APPLICATIONS

This application is a continuation-in-part of U.S. patent application Ser. No. 12/167,223, entitled Novelty Dart With Foam Suction Cup, filed Jul. 2, 2008 now U.S. Pat. No. 8,012,049.

BACKGROUND OF THE INVENTION

1. Field of the Invention

In general, the present invention relates to novelty throwing toys, such as balls and oversized darts, that include tails for stabilization during flight. More particularly, the present invention relates to the structure of the tail section of such throwing toys and the manner by which such toys are grasped and thrown.

2. Description of the Prior Art

The use of a tail and fletching to stabilize a projectile in flight has been in existence since before recorded history. Accordingly, it is well known that the use of a tail and stabilizing fins, i.e. fletching, can be used to make many different projectiles fly both longer and straighter once launched.

Recognizing the aerodynamic advantages of tails, toy manufacturers have applied tails to many different tossable objects. For example, tails with stabilizer fins have been connected to footballs, baseballs and many other hand-thrown toys. A football with a stabilizing tail is currently being marketed under the name Howler™ as part of the Nerf® line of toys, which is manufactured by Hasbro of Rhode Island.

When a football is thrown, much of the energy applied during the throw is consumed by the wobble of the football during flight and the aerodynamic drag created by the wobble. Accordingly, care must be taken to throw the football in a tight spiral. However, when a tail is added to a football, the tail automatically acts to minimize the wobble. Furthermore, the football can be thrown without concern for creating a spiral. The result is that an average person can throw a football with a tail much farther than a football without a tail.

Although many toy manufacturers have added tails to footballs and the like, the tail does nothing else but stabilize the ball in flight. The tail is not grasped nor does it have any part in the throwing process. Rather, the toy football is grasped and thrown in the same manner as a football without a tail. The applicant has discovered a secondary use for the stabilizing tail of a hand-thrown projectile. By adding a tab to the tail, a person can now effectively throw the tossed projectile by its tail. The added leverage provided by the tail increases the launching velocity of the projectile. The projectile can, therefore, fly longer and farther than a projectile with a traditional stabilizing tail. The details of this novel invention are described and claimed below.

SUMMARY OF THE INVENTION

The present invention is a novelty hand-thrown projectile. The projectile has an enlarged head made from a soft material. A shaft is used to connect the enlarged head to a tail structure. The shaft is a plastic molded structure having a first end, a second end, a semi-flexible section and a flexible section. The flexible section is interposed between said semi-flexible section and said second end. The flexible section is created by flattening the plastic of the shaft into a wide, easily grasped tab. Because the tab is wider and thinner than the remainder of the shaft, the tab is far more flexible than is the remainder of the shaft.

A plurality of stabilization fins are provided that radially extend from the semi-flexible section of the shaft.

To toss the hand-thrown projectile, a person grasps the flexible tab. As the projectile is thrown, inertia and the acceleration forces created by the throw cause the semi-flexible section of the shaft to bend. As the shaft bends, it stores spring energy. Furthermore, a whipping effect is created as the enlarged head of the projectile travels faster and farther than the user's hand creating the toss.

Upon release of the flexible tab, the energy stored in the bent shaft is released. This energy is transferred into the initial velocity of the projectile. As a consequence, the hand-thrown projectile flies faster and farther than if the enlarged head of the projectile were grasped directly and thrown.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be configured as many types of toy projectiles, such as toy darts or toy balls, the present invention is especially well suited for being configured as an oblong projectile, such as a football. Accordingly, the present invention is illustrated and described having a football-shaped head in order to set forth the best mode contemplated for the invention. However, the illustrated embodiment is only intended to be exemplary and should not be considered a limitation upon other possible embodiments of the invention contained within the scope of the claims.

Figure 1:
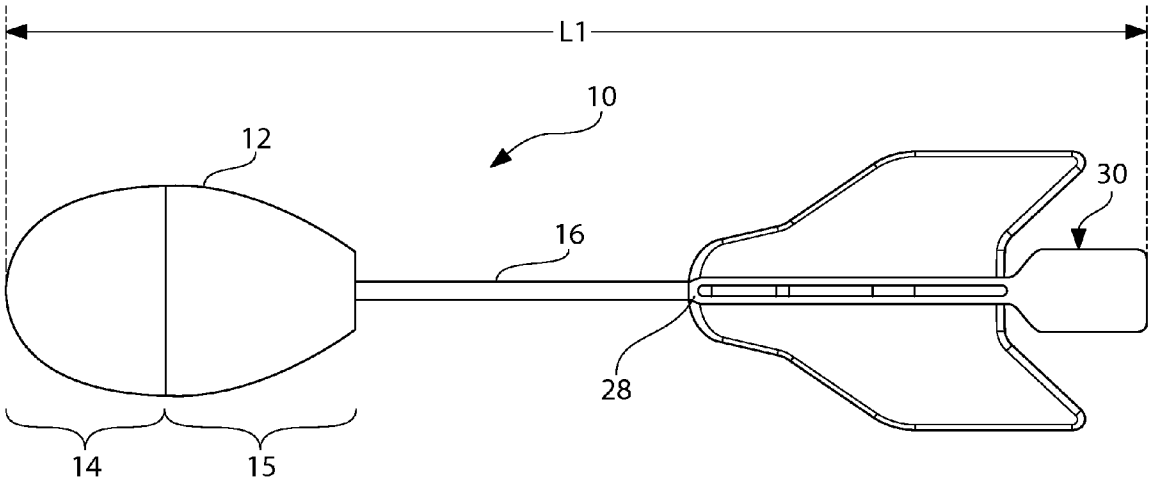
FIG. 1 is a front view of an exemplary embodiment of a hand-thrown projectile.
Figure 2:
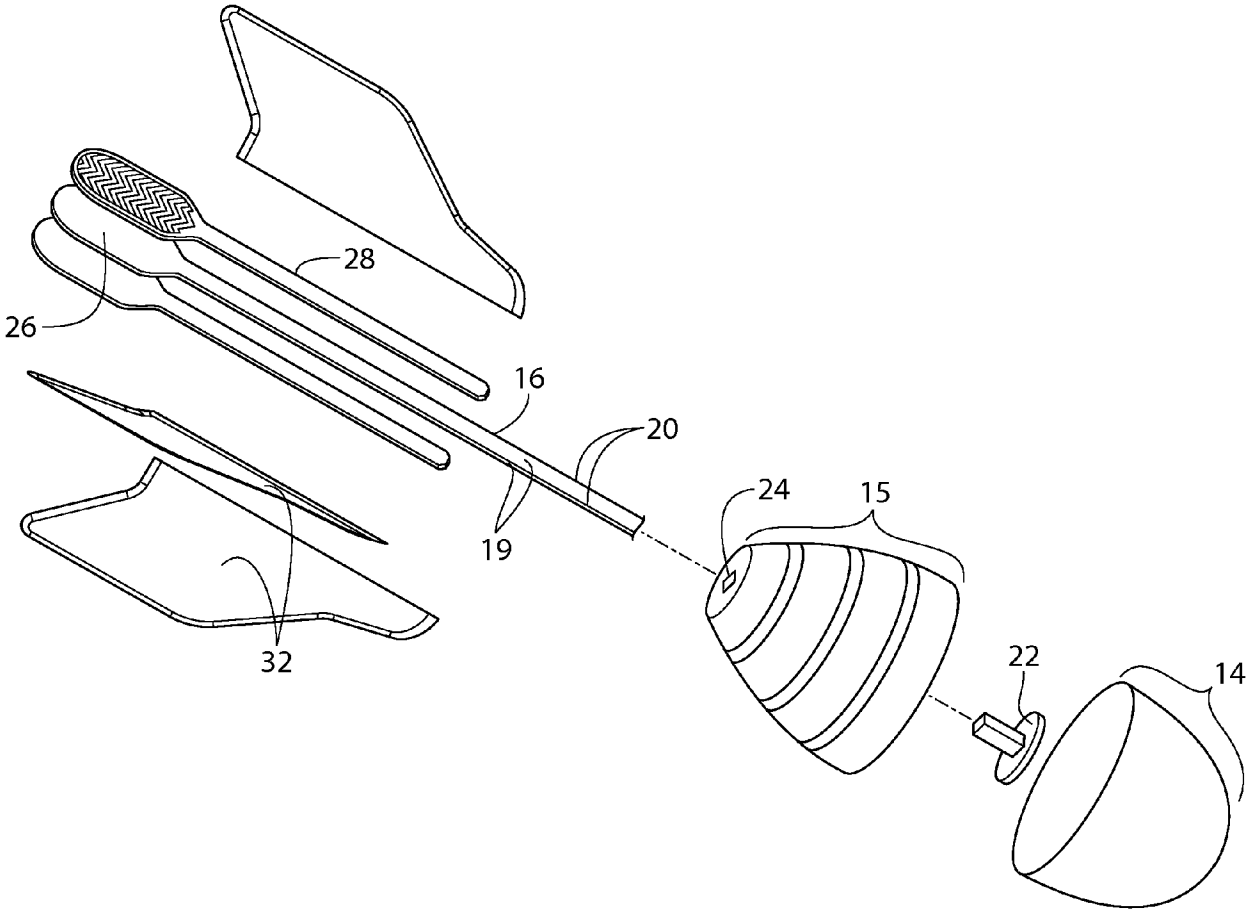
FIG. 2 is an exploded perspective view of the embodiment of FIG. 1.
Figure 3:
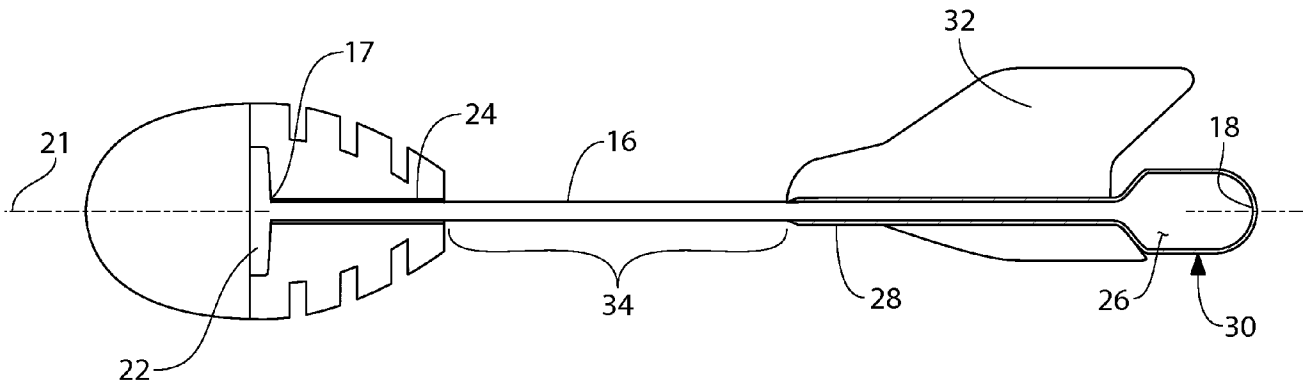
FIG. 3 is a cross-sectional view of the embodiment of FIG. 1.

Referring to FIG. 1 in conjunction with both FIG. 2 and FIG. 3, an exemplary hand-thrown toy projectile 10 is shown. The hand-thrown toy projectile 10 has a preferred overall body length L1 of between eight and fourteen inches.

The toy projectile 10 includes a head structure 12. The head structure 12 has a forward section 14 and an opposite rearward section 15. The head structure 12 is oblong in shape like a traditional American football. The head structure 12 can be unistructurally formed as a single piece. However, in the shown embodiment, the forward section 14 and the rearward section 15 are separately manufactured and are adhesively joined to form the complete head structure 12. By making the forward section 14 and the rearward section 15 of the head structure 12 separately, it becomes possible to form both the forward section 14 and the rearward section 15 out of material that differs in type, color, texture and/or density.

The forward section 14 of the head structure 12 is the part of the hand-thrown projectile 10 that bears the brunt of impact. Accordingly, the forward section 14 of the head structure 12 is preferably made of a soft polymer foam material. Such material minimizes any chance of injury, should the hand-thrown projectile 10 strike a person. However, molded head structures and even plush head structures can be used.

Although the head structure 12 can be made in many different shapes and sizes, it is preferred that the mass of the head structure 12 be sufficient to account for more than fifty percent (50%) of the weight of the overall hand-thrown projectile 10. In this manner, the hand-thrown projectile 10 will always be head-heavy during flight.

A flexible shaft 16 is provided. The shaft 16 has a first end 17 and a second end 18. The shaft 16 is linear, progressing along a straight longitudinal axis 21 between its first end 17 and its second end 18. The shaft 16 is preferably made of a flexible plastic that can bend at least 90° without breaking and returns to a linear configuration after such a bend. Although the shaft 16 can have a round cross-section, most of the shaft 16 in the illustrated embodiment has a generally square cross-section with four side surfaces 19 and four corners 20. It will therefore be understood that the shaft 16 bends more readily in the directions of the flat side surfaces 19 rather than in the directions of the corners 20. The complex profile of the shaft 16 enables a flexible plastic to be used in its manufacture. The flexible plastic provides the bending characteristics required, while the complex shaft geometry provides the rigidity needed for the shaft 16 to return to a straight form after bending.

The first end 17 of the shaft 16 is anchored to the head structure 12. This can be done in numerous ways. For example, the first end 17 of the shaft 16 can simply be adhered to a hole formed in the head structure 12. However, in the shown embodiment, an enlarged anchor 22 is formed at the first end 17 of the shaft 16. A hole 24 is formed through the rearward section 15 of the head structure 12. The shaft 16 is extended through the hole 24. The enlarged anchor 22 is adhered into place when the forward section 14 of the head structure 12 is adhered to the rearward section 15. As such, the enlarged anchor 22 is hidden and the shaft 16 extends rearwardly from the center of the head structure 12.

The shaft 16 is formed into a flat section 26 proximate its second end 18. The flat section 26 is aligned with the longitudinal axis 21 of the shaft 16. However, the flat section 26 is thinner and wider than the remainder of the shaft 16. This makes the flat section 26 the flexible portion of the shaft 16, while the remainder of the shaft 16 is only semi-flexible in comparison. The flexible nature of the flat section 26 enables the flat section 26 to be deformed up and down out of alignment with the longitudinal axis 21.

The flat section 26 is oriented in a plane that bisects the shaft 16 between opposite corners 20. As such, it will be understood that the flat section 26 is far more flexible than is the remainder of the shaft 16. Furthermore, the flat section 26 is oriented to flex in the directions that the remainder of the shaft 16 is most stiff.

A soft plastic or plastic foam tail base 28 is molded around the flat section 26 of the shaft 16 and around a portion of the shaft 16 leading toward the flat section 26. The addition of the tail base 28 to the flat section 26 makes the flat section 26 larger and creates a flexible tab 30 that is linearly aligned with the longitudinal axis 21 of the shaft 16. The flexible tab 30 is soft and is the rear most part of the hand-thrown projectile 10. The flexible tab 30 preferably has a top surface area of between 0.5 square inches and 2.0 square inches. This makes the flexible tab 30 easy to grasp between the index finger and thumb.

A plurality of stabilizing fins 32 are provided. The stabilizing fins 32 are adhered to the tail base 28 in a symmetrical pattern. The stabilizing fins 32 are preferably made of plastic foam or a similar soft material.

An exposed section 34 of the shaft 16 remains between the head structure 12 and the tail base 28. To improve the aesthetics of the overall hand-thrown projectile 10, the exposed section 34 of the shaft 16 can be painted, coated, or covered with a secondary material.

Figure 4:
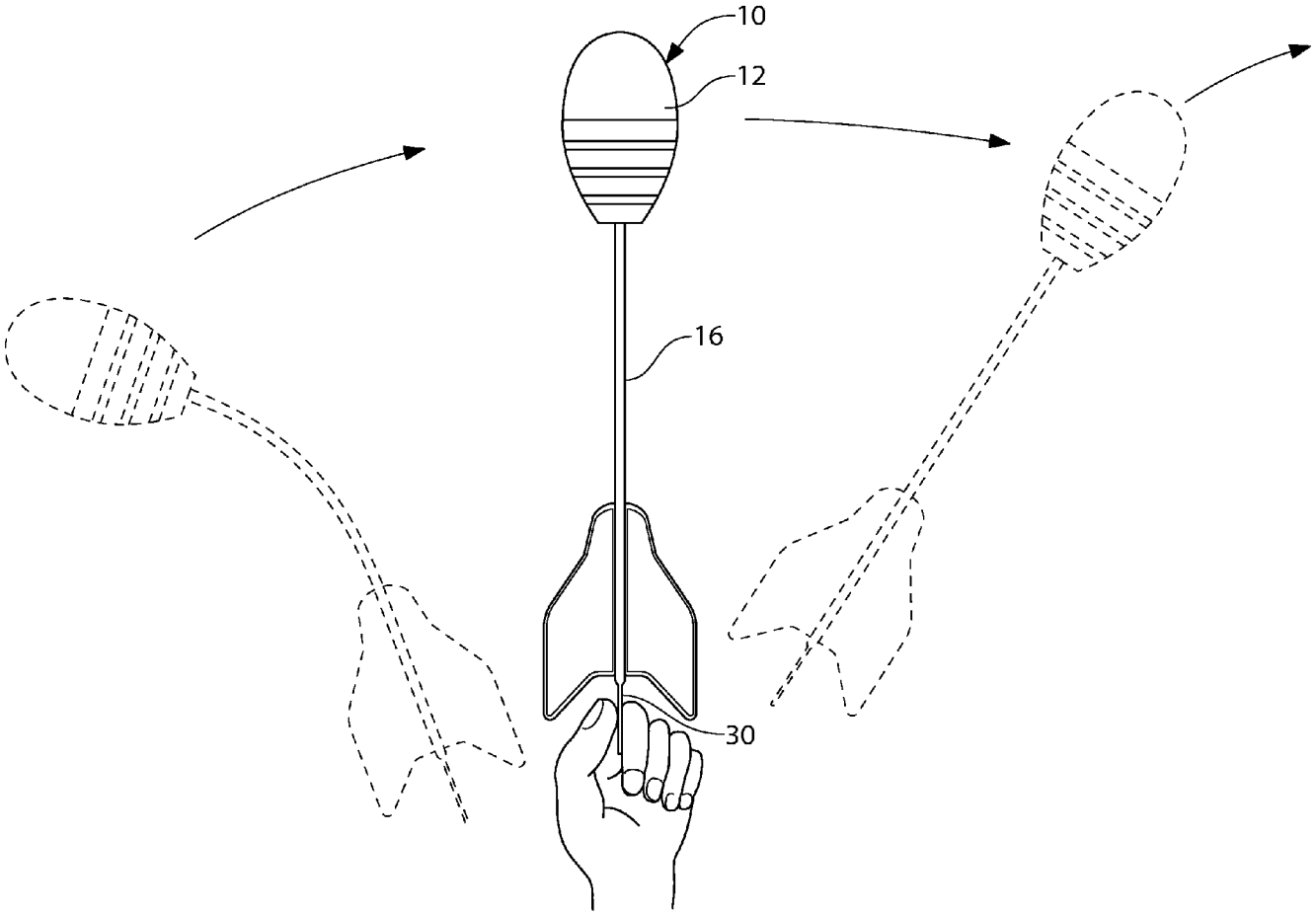
FIG. 4 is a side view of the exemplary hand-thrown projectile shown during a throw.

Referring to FIG. 4, it can be seen that in order to toss the hand-thrown projectile 10, a person grasps the flexible tab 30 and only the flexible tab 30. As the projectile 10 is thrown, inertia and the acceleration forces created by the throw cause the head section 12 to lag behind and create a bend in the shaft 16. Due to the orientation of the flexible tab 30, the shaft 16 bends in its stiffest orientation. As the shaft 16 bends, it stores spring energy. Furthermore, since the head structure 12 is at the far end of the shaft 16, a whipping effect is created and the head structure 12 of the projectile 10 travels faster and farther than the hand creating the toss.

Upon release of the flexible tab 30, the energy stored in the bent shaft 16 is released. This energy is transferred into the initial velocity of the projectile toy 10. The result is that the projectile toy 10 is launched at an initial velocity that is significantly faster than the velocity of the hand creating the toss. As a consequence, the hand-thrown projectile 10 flies faster and farther than if the head structure 12 of the projectile 10 were grasped and thrown directly.

It will be understood that the embodiment of the present invention that is illustrated and described is merely exemplary and that a person skilled in the art can make many alternate embodiments. For example, the toy projectile 10 can have a head of many different shapes and shafts of many different lengths. Furthermore, features such as the shape and number of stabilizing fins are a matter of design choice. All such variations, modifications and alternate embodiments are intended to be included within the scope of the present invention as defined by the claims.

What is claimed is:

1. A novelty hand-thrown projectile, comprising:

a molded plastic shaft having a first end, a second end, a semi-flexible section and a flexible section wherein said flexible section is interposed between said semi-flexible section and said second end;

a head structure coupled to said first end of said shaft; and a plurality of stabilizing fins radially extending from said semi-flexible section of said shaft.

2. The projectile according to claim 1, wherein said shaft is straight and said semi-flexible section and said flexible section are aligned along a common longitudinal axis.

3. The projectile according to claim 2, wherein said semi-flexible section of said shaft has a uniform first width and thickness, and wherein said flexible section of said shaft has a greater width and a lesser thickness than said uniform first width and thickness.

4. The projectile according to claim 1, wherein said semi-flexible section and said flexible section are unistructurally formed as a single piece of plastic.

5. The projectile according to claim 4, wherein said enlarged anchor is encased within said head structure.

6. The projectile according to claim 1, further including an enlarged anchor formed at said first end of said shaft.

7. The projectile according to claim 1, wherein said head structure is formed from a foam polymer.

8. The projectile according to claim 1, further including a polymer coating formed around said flexible section of said shaft and a portion of said semi-flexible section of said shaft proximate said flexible section.

9. The projectile according to claim 8, wherein said stabilizing fins are adhered to said polymer coating.

10. A novelty hand-thrown projectile, comprising:

a shaft having a longitudinal axis;

a flexible tab extending from said shaft, said flexible tab having a flattened section of a flexible plastic that is unistructurally formed as part of said shaft, wherein said flexible tab is aligned with said longitudinal axis of said shaft;

a head structure coupled to said shaft at an end of said shaft opposite said flexible tab;

a plurality of stabilization fins radially extending about said longitudinal axis.

11. The projectile according to claim 10, wherein said flexible tab includes a soft polymer coating surrounding said flattened section.

12. The projectile according to claim 11, wherein said flexible tab has a flat top surface with an area of between 0.5 square inches and 2.0 square inches.

13. A novelty projectile, comprising:

an enlarged head structure having a forward section and a rearward section, wherein said head structure is formed from a foam polymer;

a straight shaft extending from said rearward section of said head structure;

stabilizer fins radially extending from said shaft; and a flexible tab coupled to said shaft, wherein said flexible tab is linearly aligned with said shaft and wherein said flexible tab extends behind said stabilizer fins so that said stabilizer fins are positioned in between said head structure and said flexible tab.

14. The projectile according to claim 13, wherein said shaft and at least a portion of said flexible tab are unistructurally formed as a single piece of plastic.

15. The projectile according to claim 13, further including an enlarged anchor formed at one end of said shaft.

16. The projectile according to claim 15, wherein said enlarged anchor is encased within said head structure.

17. The projectile according to claim 13, further including a polymer coating formed around said flexible tab and a portion of said shaft.

18. The projectile according to claim 17, wherein said stabilizer fins are adhered to said polymer coating.

* * * * *